US006598346B1

(12) United States Patent
Öhman

(10) Patent No.: US 6,598,346 B1
(45) **Date of Patent: *Jul. 29, 2003**

(54) DEVICE FOR TURNABLE WINDOWS

(76) Inventor: Hans Öhman, Lindonvägen 5, SE-426 55 Västra Frölunda (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/509,663

(22) PCT Filed: Oct. 2, 1998

(86) PCT No.: PCT/SE98/01775

§ 371 (c)(1),
(2), (4) Date: May 2, 2000

(87) PCT Pub. No.: WO99/18319

PCT Pub. Date: Apr. 15, 1999

(30) Foreign Application Priority Data

Oct. 2, 1997 (SE) ..... 9703588

(51) Int. Cl.[7] ..... E05D 15/00
(52) U.S. Cl. ..... 49/390
(58) Field of Search ..... 49/149, 153, 154, 49/155, 158, 159, 160, 162, 174, 175, 176, 177, 193, 394, 395, 388, 390, 391, 392, 393

(56) References Cited

U.S. PATENT DOCUMENTS

| | | | | | |
|---|---|---|---|---|---|
| 3,507,073 A | * | 4/1970 | Wegefelt | | 49/390 X |
| 3,936,978 A | | 2/1976 | Barras | | |
| 4,007,558 A | | 2/1977 | Heggdal | | |
| 4,059,924 A | * | 11/1977 | Bierlich | | 49/390 X |
| 4,571,885 A | * | 2/1986 | Uemura et al. | | 49/177 |
| 5,924,244 A | * | 7/1999 | Ohman | | 49/252 |

FOREIGN PATENT DOCUMENTS

| | | | | |
|---|---|---|---|---|
| DE | 835346 | | 2/1952 | |
| EP | 490707 | * | 6/1992 | 49/177 |
| FR | 2278898 | | 2/1976 | |
| GB | 2227273 A | | 7/1990 | |
| NO | 101666 | | 2/1963 | |
| SE | 408721 | | 7/1979 | |
| SE | 505297 | | 8/1997 | |
| WO | 96/17151 | * | 6/1996 | |

* cited by examiner

*Primary Examiner*—Jerry Redman
(74) *Attorney, Agent, or Firm*—Burns, Doane, Swecker & Mathis, L.L.P.

(57) ABSTRACT

A device for turnable windows including a frame having a first side face and a second side face, each of the side faces of the frame including a longitudinal groove; a casement having a first edge side face and a second edge side face, the casement being pivotally mounted within the frame by pivots positioned at mid-points of the casement and a link-arm mechanism extending between a respective pivot and the frame, each of the first edge side face and the second edge side face including a first guide bushing and a second guide bushing. The first and second guide bushings of each of the edge side faces travel in a respective one of the grooves. A rotatable lever simultaneously extends or retracts one of the pair of first guide bushings or the pair of second guide bushings into or out of engagement with their respective grooves.

3 Claims, 3 Drawing Sheets

DEVICE FOR TURNABLE WINDOWS

This application is a national stage filing under 35 U.S.C. § 371 of International Application No. PCT/SE98/01775 filed on Oct. 2, 1998.

TECHNICAL FIELD

The invention concerns an improved window, the casement of which is mounted on pivots in its associated frame.

BACKGROUND OF THE INVENTION

Double glazing and well as triple glazing windows have been developed lately in which the window panes are treated to prevent strong heat radiation from penetrating the glazing. Instead, part of the heat radiation is reflected back into the atmosphere. In this manner it has become possible to prevent powerful sunlight from heating the premises in a building excessively during the summer, with resulting economy of for instance the energy required to operate an air conditioning system. In many cases it has also become possible to do without Venetian blinds.

However, as summer progresses into autumn and winter, the conditions are the opposite ones. During this period it is desirable to prevent thermal energy in the heated premises from radiating through the windows and into the atmosphere.

From the Swedish Patent Specification No. 505 297 is known a device by means of which a casement may be pivoted from a closed position with respect to a frame, over half a turn into a reversed, closed position, and to lock the casement in said closed position. Following its release, the casement may be pivoted from the closed position, either further in the same direction or backwards in the opposite direction. In this manner the device offers the user a choice of which side of the window he wishes should be directed outwards and which to be turned inwards during a certain period.

In order to lock the casement in the closed position thereof the frame is fitted with a locking mechanism comprising a rotatable member and a catch, the latter being movable into and out of a casement securing position adjacent a stationary guide bushing mounted on the window frame. To this end, the frame must be formed with a transverse groove which is open towards the atmosphere and which runs into a longitudinally extending groove designed to guide the guide bushing, to ensure that the latter travels towards the locking mechanism upon closing of the casement and outwards, into the open air upon pivotal movement outwards of the casement.

SUMMARY OF THE INVENTION

The object of the subject invention is to simplify the construction defined above. This object is achieved by the provision of a rotatable lever mounted in the casement or the frame and by means of which guide bushings may be extended or retracted simultaneously in pairs out of respectively into said grooves. This arrangement obviates the need for a separate catch, and the longitudinal grooves no longer need terminate in a transverse groove. Yet, the same possibilities as before are available, in that when the casement has been pivoted over half a turn in the reverse direction and closed and locked in said reversed position by retraction of one of the pairs of guide bushings, the casement may be pivoted in the reverse direction, or its pivotal movement in the same direction as originally may be continued by retraction of the opposite pair of bushings.

BRIEF DESCRIPTION OF THE DRAWINGS

The invention will be described in closer detail in the following with reference to the accompanying drawings, wherein.

DETAILED DESCRIPTION OF THE INVENTION

Figure 1:
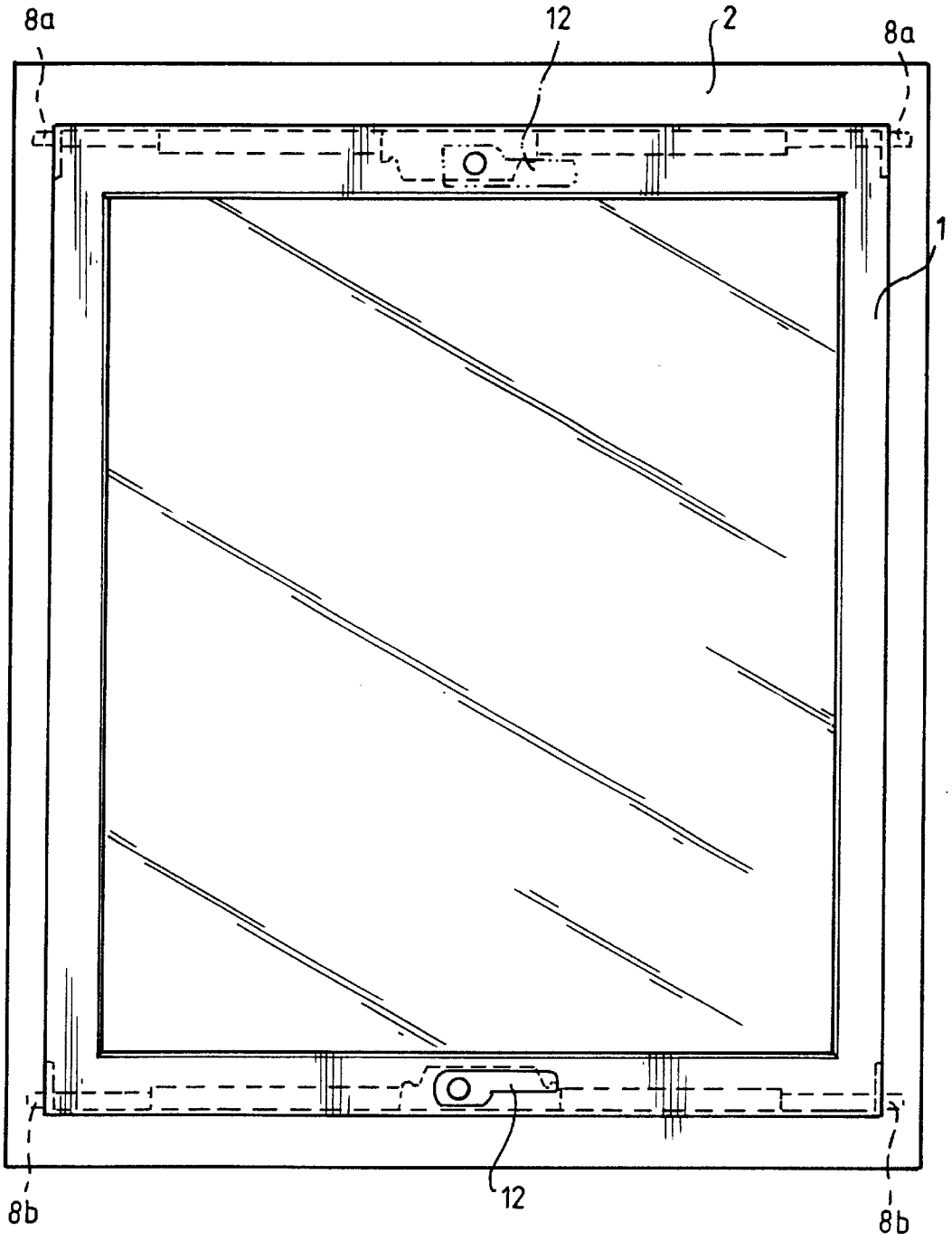
FIG. 1 is a plan view of the casement and the frame of a window.
Figure 2:
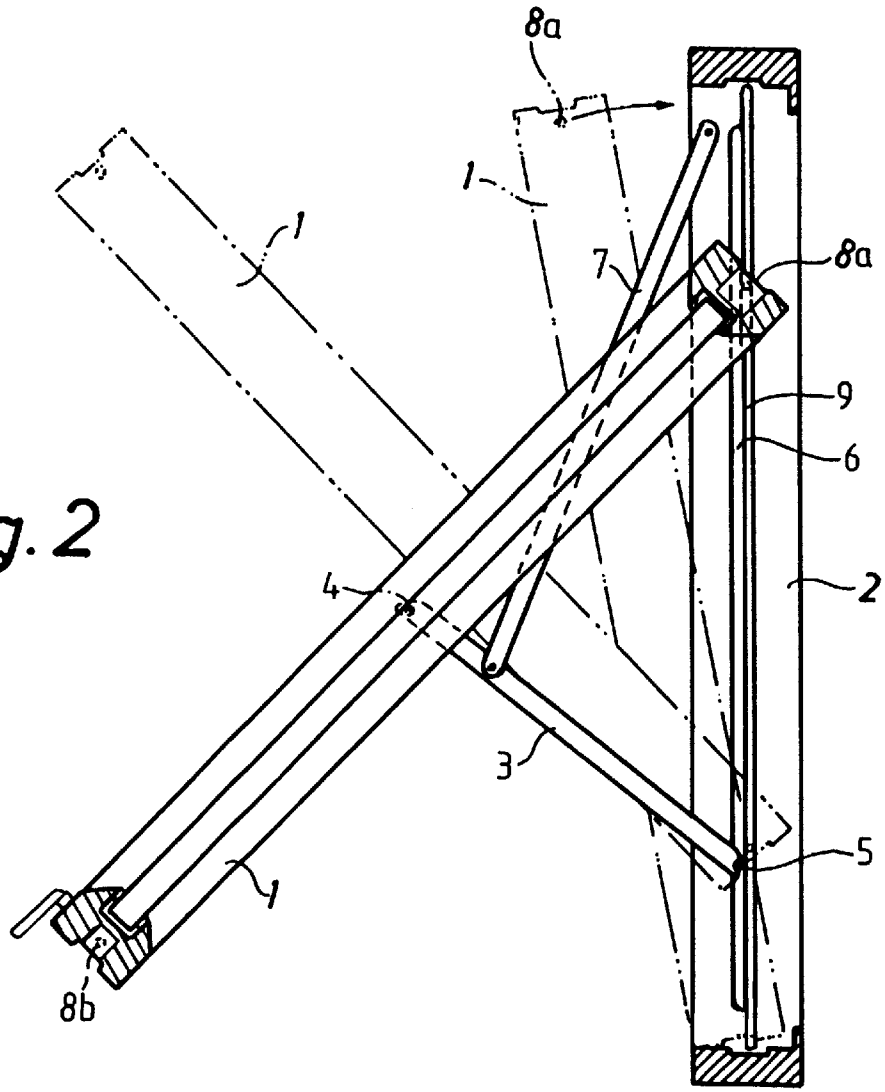
FIG. 2 is a schematic representation of the frame and its associated casement, wherein the latter is shown in various pivotal positions.

The window to be described in the following comprises a casement 1, which is mounted on pivots in a frame 2 by means of a link-arm mechanism of a construction known per se. This link-arm mechanism consists of a link arm 3, one end of which is pivotally mounted on a pivot 4 in the window casement 1 whereas its opposite end is provided with a bushing 5 travelling in a groove 6 formed in the frame 2. A second link arm 7 is pivotally mounted in the frame 2 at one of its ends while its opposite end is hingedly connected to the link arm 3 at a point somewhat interiorly of the pivot 4 on the casement 1. Guide bushings 8*a* and 8*b*, one at each corner of the casement 1, travel in a groove 9 extending in parallel with groove 6 in the frame 2.

Figure 3:
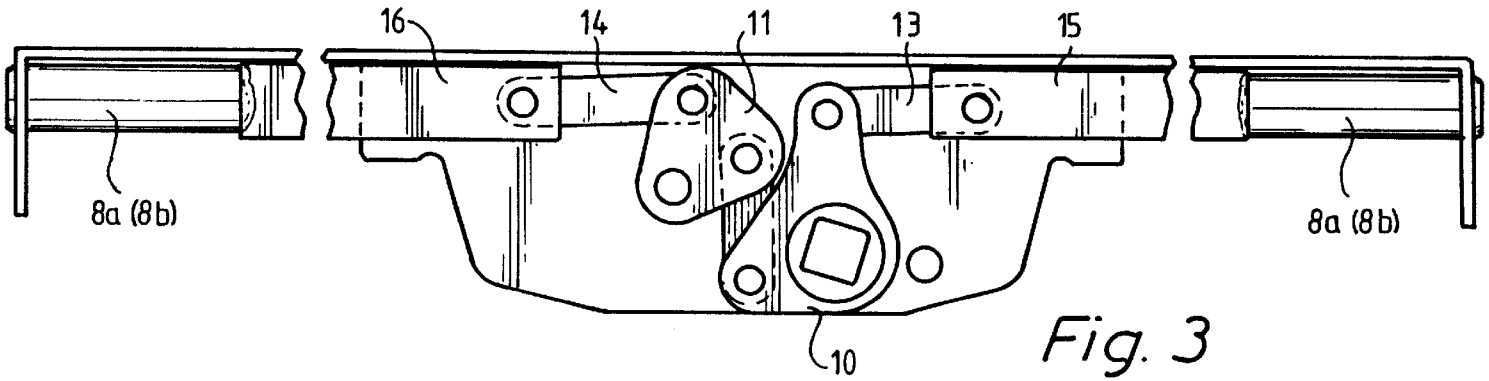
FIGS. 3 and 4 illustrate on an enlarged scale and in two different positions a guide-bushing pair and a link-arm mechanism interconnecting said bushings and being associated with a rotatable member or lever.
Figure 4:
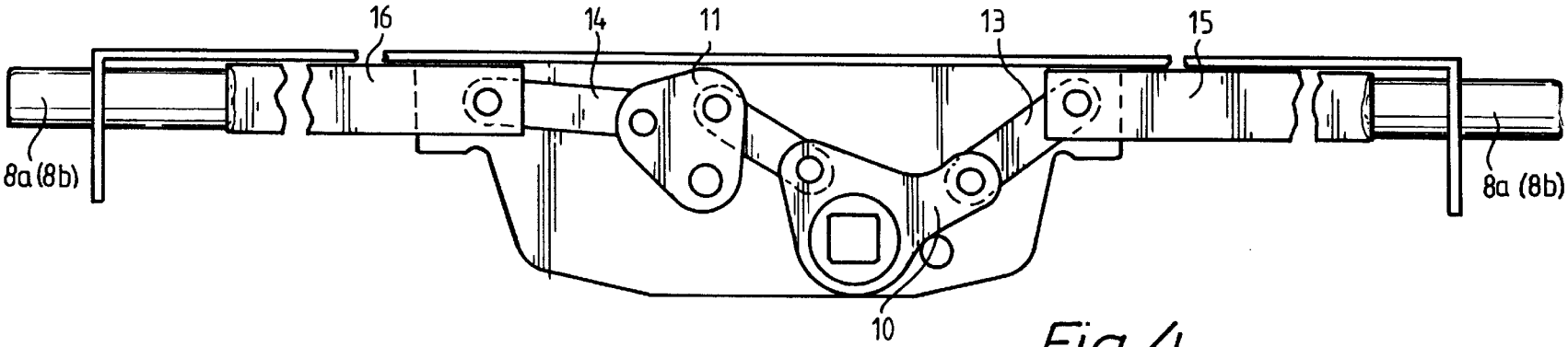

FIGS. 3 and 4 illustrate a locking mechanism, like-wise of a construction known per se, which in the conventional manner is built into the casement 1. This locking mechanism consists of two pivotally inter-connected links 10 and 11. A rotatable member or lever 12 may be removably connected to the first-mentioned link 10, see FIG. 1. Link arms 13 and 14, respectively, and displacement rods 15 and 16, respectively, connect the links 10, 11 with one of guide bushings 8*a* or 8*b*.

With the aid of the rotatable lever 12 the guide bushings 8*a*, 8*b* may be displaced from the position illustrated in FIG. 3 in which the casement 1 may be pivoted outwards while two of the guide bushings, 8*a* or 8*b*, slidably move inside their associated one of grooves 9, to the position illustrated in FIG. 4 in which the casement 1, once it occupies its closed position, may be locked in response to the two remaining guide bushings 8*a* or 8*b* entering into the grooves 9 in the frame 2 on either side of the casement 1.

Because of the removable mounting of the rotatable lever 12 it becomes possible, from the initial position illustrated in FIG. 1, wherein both pairs of guide bushings 8*a* and 8*b* assume the locking position, to open the window as desired by pivoting the upper or the lower portion of the casement 1 outwards merely by shifting the rotatable lever from one link-arm mechanism to the other.

The invention is not limited to the features illustrated and described herein but may be varied in many ways within the scope of the appended claims. Obviously, the device in accordance with the invention may be arranged in such a way that the window may be pivoted either horizontally or vertically. In addition, the rotatable mechanism 12 may be located in the frame 2 rather than in the casement 1 and, in response to its rotary movement, actuate force-transfer means which are removably connected with the locking mechanism 10, 11 and 13 to 16.

What is claimed is:

1. A device for turnable windows comprising:

a frame having a first side face and a second side face, each of said side faces of said frame including a longitudinal groove;

a casement having a first edge side face and a second edge side face, said casement being pivotally mounted within said frame by pivots positioned at mid-points of the casement and a link-arm mechanism extending between a respective said pivot and the frame, each of said first edge side face and said second edge side face including a first selectively retractable guide bushing and a second selectively retractable guide bushing, said first and second guide bushings of each said edge side face traveling in a respective one of said longitudinal grooves, and a rotatable lever which simultaneously extends or retracts one of said pair of first guide bushings and said pair of second guide bushings into or out of engagement with said respective longitudinal grooves;

wherein said casement obtains an ajar position in said frame when one of said pair of first guide bushings and said pair of second guide bushings engage said respective longitudinal grooves; and wherein said casement may be pivoted from the ajar position in a reverse direction over half a turn and be closed in a reversed position by retraction of said one of said pair of first guide bushings and said pair of second guide bushings and then extension thereof into engagement with said respective longitudinal grooves.

2. The device of claim 1 wherein, from said closed reversed position, said casement may be pivoted in an opposite direction by further retraction of said one of said pair of first guide bushings and said pair of second guide bushings out of engagement with said respective grooves.

3. The device of claim 1 wherein, from said closed reversed position, said casement may continue to be pivoted in the reverse direction by retraction of the other one of said pair of first guide bushings and said pair of second guide bushings out of engagement with said respective grooves.

* * * * *